US006488073B1

(12) United States Patent
Blenkinsop et al.

(10) Patent No.: US 6,488,073 B1
(45) Date of Patent: Dec. 3, 2002

(54) METHOD OF ADDING BORON TO A HEAVY METAL CONTAINING TITANIUM ALUMINIDE ALLOY AND A HEAVY METAL CONTAINING TITANIUM ALUMINIDE ALLOY

(75) Inventors: Paul A. Blenkinsop, Sutton Coldfield (GB); Alastair B. Godfrey, Fleet (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 09/608,228

(22) Filed: Jun. 30, 2000

(30) Foreign Application Priority Data

Jul. 2, 1999 (GB) ..... 9915394

(51) Int. Cl.[7] ..... B22D 27/00
(52) U.S. Cl. ..... 164/57.1; 164/97
(58) Field of Search ..... 148/538, 549; 164/97, 57.1

(56) References Cited

U.S. PATENT DOCUMENTS

| | | | | |
|---|---|---|---|---|
| 4,988,396 A | * | 1/1991 | Bibber | 148/269 |
| 5,059,490 A | | 10/1991 | Brupbacher | |
| 5,284,620 A | | 2/1994 | Larsen, Jr. | |
| 5,397,533 A | * | 3/1995 | Morikawa et al. | 420/418 |
| 5,429,796 A | | 7/1995 | Larsen, Jr. | |

FOREIGN PATENT DOCUMENTS

| | | | |
|---|---|---|---|
| EP | 0 577 116 A | | 1/1994 |
| GB | XP002151500 | AB | 10/1995 |
| JP | 07-157835 | A | 6/1995 |
| JP | 07157835 | AB | 6/1995 |
| WO | PCT/US99/02212 | A | 10/1999 |

OTHER PUBLICATIONS

Cheng, T, "On the mechanism of boron–induced grain refinement in TiAl based alloys", Proceedings of 1999 TMS Annual Meeting, Gamma Titanium Aluminides, Mar. 4, 1999.*

Mishima, Akira, "Effects of addition of boride on ductility and oxidation resistance of sintered TiAl alloy", Chem abstracts No. 167,328, vol. 122 No. 14, Apr. 3, 1995.*

* cited by examiner

*Primary Examiner*—George Wyszomierski
*Assistant Examiner*—Janelle Combs-Morillo
(74) *Attorney, Agent, or Firm*—W. Warren Taltavull; Manelli Denison & Selter

(57) ABSTRACT

A method of adding boron to a tungsten, or tantalum, containing titanium aluminide alloy to form a boride dispersion in the tungsten, or tantalum, containing titanium aluminide. A molten tungsten, or tantalum, containing titanium aluminide alloy is formed and tungsten, or tantalum, boride is added to the molten tungsten, or tantalum, containing titanium aluminide alloy to form a molten mixture. The molten mixture is cooled and solidified to form a tungsten, or tantalum, containing titanium aluminide alloy having a uniform dispersion of tungsten, or tantalum, boride particles substantially without the formation of clusters of tungsten, or tantalum, boride. The titanium aluminide alloy comprises between 0.5 at % and 2.0 at % boron.

13 Claims, 1 Drawing Sheet

METHOD OF ADDING BORON TO A HEAVY METAL CONTAINING TITANIUM ALUMINIDE ALLOY AND A HEAVY METAL CONTAINING TITANIUM ALUMINIDE ALLOY

FIELD OF THE INVENTION

The present invention relates to a titanium aluminide alloy, particularly to titanium aluminide alloys comprising heavy metals, for example tungsten, or tantalum, and which have a dispersion of borida particles.

BACKGROUND OF THE INVENTION

Titanium aluminide alloys have potential for use in gas turbine engines, particularly for turbine blades and turbine vanes in the low pressure turbine and compressor blades and vanes in the high pressure compressor. The gamma titanium aluminides provide a weight reduction compared to the alloys currently used for these purposes.

It is known to provide some titanium aluminide alloys with tungsten, such as for example see U.S. Pat. No. 5,296,056, and it is known to provide some titanium aluminide alloys with tantalum, for example see UK patent application GB2,245,593A and UK patent application GB2,250,999A.

It is also known that titanium aluminide alloys may be modified to improve the mechanical properties of the titanium aluminide alloy articles by the addition of boron which forms titanium diboride when the titanium aluminide alloy has solidified. The titanium diboride is an effective grain refiner for the titanium aluminide alloy which improves the castability, mechanical formability and mechanical properties, in particular increased ductility and creep resistance, of the titanium aluminide alloy. See for example U.S. Pat. Nos. 5,284,620, 5,429,796, UK patent application GB2,245,593A and UK patent application GB2,250,999A. In order to provide grain refinement the addition of boron in quantities of about 0.5 to about 2 at % is required However, it has been found that the addition of boron, or borides, into a tantalum, or tungsten, containing titanium aluminide alloy may result in the formation of precipitate clusters and/or stringers of tantalum boride, or tungsten boride, in the titanium aluminide alloy. This is because the tungsten, or tantalum, in the titanium aluminide alloy reacts with the boron to form the tungsten boride or tantalum boride. The precipitate clusters have a maximum dimension of about 500 $\mu$m and are predominantly tungsten boride in tungsten containing titanium aluminides or tantalum boride in tantalum containing titanium aluminides. U.S. Pat. Nos. 5,284,620 and 5,429,796 add the borides into the titanium aluminide alloy in the form of titanium diboride particles and it has been found that the addition of titanium diboride particles to the tungsten, or tantalum, containing titanium aluminide alloys results in the formation of the tungsten boride, or tantalum boride, precipitate clusters.

GB2,245,593A and GB2,250,999A add the boride into the titanium aluminide alloy in the form of elemental boron and it believed that the addition of elemental boron to the tungsten, or tantalum, containing titanium aluminide alloys may result in the formation of the tungsten boride, or tantalum boride, precipitate clusters.

SUMMARY OF THE INVENTION

Accordingly the present invention seeks to provide a novel way of adding boron to a heavy metal containing titanium aluminide alloy which at least reduces the above mentioned problems.

Accordingly the present invention provides a method of adding boron to a heavy metal containing titanium aluminide alloy to form a boride dispersion in the heavy metal containing titanium aluminide, comprising:-

(a) forming molten heavy metal containing titanium aluminide alloy, (b) adding heavy metal boride particles to the molten heavy metal containing titanium aluminide alloy to form a molten mixture, the heavy metal boride particles having the same form as undesirable heavy metal boride precipitate clusters, (c) cooling and solidifying the molten mixture to form a heavy metal containing titanium aluminide alloy having a uniform dispersion of heavy metal boride particles substantially without the formation of heavy metal boride precipitate clusters.

Preferably step (a) comprises forming molten tungsten containing titanium aluminide alloy, (b) adding tungsten boride to the molten tungsten containing titanium aluminide alloy to form a molten mixture, the tungsten boride particles having the same form as undesirable tungsten boride precipitate clusters, (c) cooling and solidifying the molten mixture to form a tungsten containing titanium aluminide alloy having a dispersion or tungsten boride particles substantially without the formation of tungsten boride precipitate clusters.

Alternatively step (a) comprises forming molten tantalum containing titanium aluminide alloy, (b) adding tantalum boride to the molten tantalum containing titanium aluminide alloy to form a molten mixture, the tantalum boride particles having the same foam as undesirable tantalum boride precipitate clusters, (c) cooling and solidifying the molten mixture to form a tantalum containing titanium aluminide alloy having a dispersion of tantalum boride particles substantially without the formation or tantalum boride precipitate clusters.

Preferably the titanium aluminide alloy comprises up to 2.0 at % boron, more preferably the titanium aluminide alloy comprises up to 1.0 at % boron and preferably the titanium aluminide alloy comprises more than 0.5 at % boron.

Preferably the heavy metal boride particles added have a size of 1 to 5 $\mu$m.

Preferably the density of heavy metal boride precipitate clusters is up to 3 $cm^{-2}$, more preferably the density of heavy metal boride precipitate clusters is less than 2 $cm^{-2}$, more preferably there are substantially no heavy metal boride precipitate clusters.

Preferably the heavy metal boride precipitate clusters have a maximum size of 150 $\mu$m, more preferably the heavy metal boride precipitate clusters have a maximum size of 100 $\mu$m.

Preferably the titanium aluminide alloy comprises a gamma titanium aluminide.

Preferably the method comprises forming the titanium aluminide alloy into a turbine blade, a turbine vane, a compressor blade, or a compressor vane.

Preferably the titanium aluminide alloy is cast or forged.

The present invention also seeks to provide a heavy metal containing titanium aluminide alloy, the titanium aluminide containing heavy metal boride particles substantially without heavy metal boride precipitate clusters, the heavy metal boride particles having the same form an the undesirable heavy metal boride precipitate clusters, and the titanium aluminide alloy comprises up to 2.0 at % boron.

Preferably the density of the heavy metal boride precipitate clusters is less than 2 $cm^{-2}$.

Preferably the heavy metal boride precipitate clusters have maximum size of 100 $\mu$m.

Preferably the heavy metal is tungsten and the heavy metal boride is tungsten boride.

Alternatively the heavy metal is tantalum and the heavy metal boride is tantalum boride.

Preferably the titanium aluminide alloy comprises a gamma titanium aluminide.

Preferably the titanium aluminide alloy is in the shape of a turbine blade, a turbine vane, a compressor blade, or a compressor vane.

BRIEF DESCRIPTION OF THE DRAWINGS

The present invention will be more fully described by way of example with reference to the accompanying drawings in which:-

DETAILED DESCRIPTION OF THE INVENTION

Figure 1:
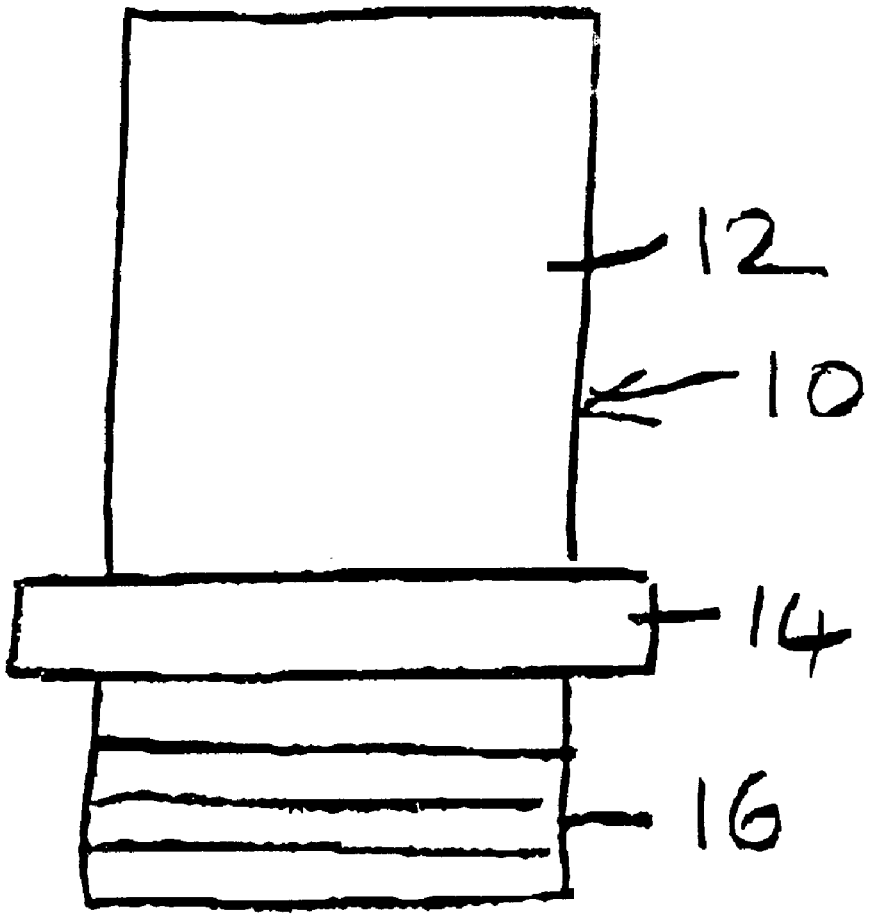
FIG. 1 shows a titanium aluminide turbine blade having a protective coating according to the present invention.

A gas turbine engine compressor turbine 10, as shown in FIG. 1, comprises an aerofoil 12, a platform 14 and a root 16. The turbine blade 10 comprises a titanium aluminide alloy, preferably gamma titanium aluminide alloy.

The titanium aluminide alloy comprises one or more of tungsten, tantalum or other heavy metals and particles of tungsten boride, tantalum boride or other heavy metal boride respectively. The density of the tungsten, tantalum or other heavy metal boride particles is up to 3 $cm^{-2}$ and the tungsten, tantalum or other heavy metal boride particles have a maximum size of 150 $\mu$m. Preferably the tungsten, tantalum or other heavy metal boride particles have maximum size of 100 $\mu$m. Preferably the density of the tungsten, tantalum or other heavy metal boride particles is less than 2 $cm^{-2}$, most preferably the density of the tungsten, tantalum or other heavy metal boride particles is zero. If the titanium aluminide alloy comprises for example tungsten and tantalum then there may be tungsten boride particles and tantalum boride particles.

The boride particles refine the grain size of the gamma titanium aluminide alloy making the gamma titanium aluminide alloy more ductile.

The boron is added into the heavy metal containing gamma titanium aluminide alloy by forming the molten heavy metal containing titanium aluminide alloy. Then heavy metal boride is added to the molten heavy metal containing titanium aluminide alloy to form a molten mixture. The heavy metal boride is added in the same form as the heavy metal boride precipitate clusters which normally form in the heavy metal containing titanium aluminide alloy. The molten mixture is then cooled and solidified to form a heavy metal containing titanium aluminide alloy having a dispersion of heavy metal boride particles. The titanium aluminide alloy comprises up to 2.0 at % boron and more than 0.5 at % boron.

EXAMPLES

Example 1

A titanium aluminide alloy comprising 47 at % aluminum, 2 at % tantalum, 1 at % chromium, 1 at % manganese, 1 at % boron, 0.2 at % silicon and the balance titanium and incidental impurities was prepared. The titanium aluminide alloy was for example prepared by mixing aluminum shot, granular titanium, flakes of chromium, flakes of manganese, chips of silicon, chopped niobium plate, chopped tantalum plate and boron was added in the form of aluminum boride. The aluminum boride comprises $AlB_{12}$ and an Al matrix.

The above mixture was heated in a vacuum chamber back filled with argon to 1 bar pressure and the titanium aluminide alloy was melted using a plasma torch and was cast into a water cooled copper crucible.

The microstructure of the resulting titanium aluminide alloy was examined and was fine grained and fully lamellar. The average grain size was about 170 $\mu$m. Additionally there were quantities of precipitate clusters in tho structures in the titanium aluminide alloy.

Example 2

A titanium aluminide alloy comprising 47 at % aluminum, 2 at % tantalum, 1 at % chromium, 1 at % manganese, 0.2 at % silicon and the balance titanium and incidental impurities was prepared. This is the same alloy am in Example 1 except without the boron.

The above mixture was heated in a vacuum chamber back filled with argon to 1 bar pressure and the titanium aluminide alloy melted using a plasma torch and was cast into a water cooled copper crucible.

It was found that there were no precipitate clusters in the structures in the titanium aluminide alloy.

Example 3

A titanium aluminide alloy comprising 47 at % aluminum, 2 at % tantalum, 1 at % manganese, 1 at % chromium, 1 at % boron, 0.2 at % silicon and the balance titanium and incidental impurities was prepared. The titanium aluminide alloy was for example prepared by mixing master alloys and boron was added in the form of aluminum boride. The aluminum boride comprises $AlB_{12}$.

The tantalum was added in the form of a tantalum and aluminum master alloy (70 wt % Ta)

The above mixture was heated in a vacuum chamber back filled with argon to 1 bar pressure and the titanium aluminide alloy was melted using a plasma torch and was cast into a water cooled copper crucible.

The microstructure of the resulting titanium aluminide alloy was examined and was fine grained and equiaxed. The average grain size was about 170 $\mu$m. Additionally there were abundant quantities of precipitate clusters in the structures similar to those in Example 1. These precipitate clusters had a maximum size of 500 $\mu$m and the density of the precipitate clusters was 90 $cm^{-2}$.

Example 4

A titanium aluminide alloy comprising 47 at % aluminum, 1 at % tungsten, 2 at % niobium, 1 at % chromium, late boron, 0.2 at % silicon and the balance titanium and incidental impurities was prepared. The titanium aluminide alloy was for example prepared by mixing master alloys and boron was added in the form of aluminum boride. The aluminum boride comprises $AlB_{12}$.

The above mixture was heated in a vacuum chamber back filled with argon to 1 bar pressure and the titanium aluminide alloy was melted using a plasma torch and was cast into a water cooled copper crucible.

The microstructure of the resulting titanium aluminide alloy was examined and was fine grained and equiaxed. The average grain size was about 250 μm. Additionally there were abundant quantities of precipitate clusters in the structures similar to those in Example 3.

The precipitate clusters formed in Examples 1, 3 and 4 were examined and it was determined that they were tantalum boride (TaB) in Examples 1 and 3 and tungsten boride (WB) in Example 4. It is believed that the tantalum reacts with the aluminum boride to form the tantalum boride precipitate clusters or that the tungsten reacts with the aluminum boride to form the tungsten boride precipitate clusters.

Example 5

A titanium aluminide alloy comprising 47 at % aluminum, 2 at % tantalum, 1 at % manganese, 1 at % chromium, 1 at % boron, 0.2 at % silicon and the balance titanium and incidental impurities was prepared. The titanium aluminide alloy was for example prepared by mixing master alloys and boron was added in the form of aluminum boride. The aluminum boride comprises $AlB_{12}$.

The tantalum was added in the form of time tantalum powder with a powder size of 9 μm.

The above mixture was heated in a vacuum chamber back filled with argon to 1 bar pressure and the titanium aluminide alloy was melted using a plasma torch and was cast into a water cooled copper crucible.

The microstructure of the resulting titanium aluminide alloy was examined and was fine grained and equiaxed. The average grain size was about 170 μm. Additionally there were abundant quantities of precipitate clusters in the structure similar to those in Example 3. These precipitate clusters had a maximum size of 400 μm and the density of the precipitate clusters was 30 $cm^{-2}$.

This showed that the form of addition of the tantalum to the titanium aluminide alloy did not control the formation of the tantalum boride precipitate clusters.

Example 6

A titanium aluminide alloy comprising 47 at % aluminum, 2 at % tantalum, 1 at % manganese, 1 at % chromium, 1 at % boron, 0.2 at % silicon and the balance titanium and incidental impurities was prepared. The titanium aluminide alloy was for example prepared by mixing master alloys and tantalum and boron were added in the form of tantalum boride. The remaining tantalum was added in the form of a tantalum and aluminum master alloy. The tantalum boride comprises a mixture of $TaB_2$ and TaB. The tantalum boride was added in the form of fine tantalum boride powder with a powder size of 1–5 μm.

The above mixture was heated in a vacuum chamber back filled with argon to 1 bar pressure and the titanium aluminide alloy was melted using a plasma torch and was cast into a water cooled copper crucible.

The microstructure of the resulting titanium aluminide alloy was examined and was fine grained and equiaxed. The average grain size was about 170 μm. Additionally there were much reduced quantities of precipitate clusters in the structures similar to those in Example 3. These precipitate clusters had a maximum size of about 100 μm and the density of the precipitate clusters was about 3 $cm^{-2}$.

Example 6

A titanium aluminide alloy comprising 47 at % aluminum, 2 at % tantalum, 1 at % manganese, 1 at % chromium, 1 at % boron, 0.2 at % silicon and the balance titanium and incidental impurities was prepared. The titanium aluminide alloy was for example prepared by mixing master alloys and tantalum and boron was added in the form of tantalum boride. The remaining tantalum was added in the form of a tantalum and aluminum master alloy. The tantalum boride comprises TaB. The tantalum boride was added in the form of fine tantalum boride powder with a powder size of 1–5 μm.

The above mixture was heated in a vacuum chamber back filled with argon to 1 bar pressure and the titanium aluminide alloy was melted using a plasma torch and was cast into a water cooled copper crucible.

The microstructure of the resulting titanium aluminide alloy was examined and was fine grained and equiaxed. The average grain size was about 170 μm. Additionally substantially no precipitate clusters in the structures similar to those in Example 3 were seen by microstructural analysis.

It is believed, in the tantalum containing titanium aluminide, that tantalum boride (TaB) precipitate clusters are formed as soon as the tantalum comes into contact with the aluminum boride during the melting procedure. It is believed that once the tantalum boride precipitate clusters have formed it is difficult to remove the tantalum boride precipitate clusters from the titanium aluminide alloy because the melting point of tantalum boride (TaB) is about 2460° C.

Similarly it is believed, in the tungsten containing titanium aluminide, that tungsten boride (WB) precipitate clusters are formed as soon as the tungsten comes into contact with the aluminum boride during the melting procedure. It is believed that once the tungsten boride precipitate clusters have formed it is difficult to remove the tungsten boride precipitate clusters from the titanium aluminide alloy because the melting point of tungsten boride (WB) is about 2655° C.

It is believed that the large precipitate clusters of tantalum boride (TaB), in the tantalum containing titanium aluminide alloy, are prevented because the addition of the tantalum boride (TaB) particles changes the reaction kinetics and prevents the large scale segregation of tantalum and boron to form the tantalum boride precipitate clusters. The tantalum boride (TaB) added is distributed, or dispersed, uniformly throughout the tantalum containing titanium aluminide alloy.

Similarly it is believed that the large precipitate clusters of tungsten boride (WB), in the tungsten containing titanium aluminide alloy, are prevented because the addition of the tungsten boride (WB) particles changes the reaction kinetics and prevents the large scale segregation of tungsten and boron to form the tungsten boride precipitate clusters. The tungsten boride (WB) added is distributed, or dispersed, uniformly throughout the tungsten containing titanium aluminide alloy.

Thus it is clear that the boron must be added to the heavy metal containing titanium aluminide alloy in the same form in which boride occurs in the precipitate clusters, to change the reaction kinetics which result in the formation of the precipitate clustering of the heavy metal and boron. Thus TaB is added to a tantalum containing titanium aluminide alloy, WB is added to a tungsten containing titanium aluminide since TaB and WB are the boride precipitate clusters formed. The addition of $TaB_2$ to a tantalum containing titanium aluminide alloy does not prevent the formation of the TaB precipitate clusters and an addition of $WB_2$ to a tungsten containing titanium aluminide does not prevent the formation of the WB precipitate clusters.

The size of the heavy metal boride particles in the titanium aluminide alloy is generally limited to that of the size of the heavy metal boride particles added to the titanium aluminide alloy.

Although the titanium aluminide alloy has been described as being used for turbine blades it may also be used for turbine vanes, compressor blades, compressor vanes. It may also be used for Internal combustion engine components.

The gamma titanium aluminide alloy preferably comprises 44 to 52 at % aluminum, one or more of tungsten and tantalum each in an amount of 0.05 to 8.0 at %, up to 2.0 at % boron and balance titanium plus incidental impurities. The gamma titanium aluminide may additionally comprise up to 3 at % chromium, up to 6 at % niobium, up to 2 at % manganese.

The gamma titanium aluminide alloy preferably comprises 45 to 47 at % aluminum, 2 to 6 at % niobium, 0.25 to 2 at % tungsten and the balance titanium plus incidental impurities. Preferably the gamma titanium aluminide comprises 45 at % aluminum, 5 at % niobium, 1 at % tungsten. The gamma titanium aluminide alloy may comprise 1 to 2 at % chromium and/or 1 to 2 at % manganese. The boron is added to a level between 0.5 and 2.0 at %.

We claim:

1. A method of adding boron to a heavy metal containing titanium aluminide alloy to form a boride dispersion in the heavy metal containing titanium aluminide, comprising:

(a) forming molten tungsten containing titanium aluminide alloy, (b) adding tungsten boride particles to the molten tungsten containing titanium aluminide alloy to form a molten mixture, the WB particles having the same form as WB precipitate clusters, (c) cooling and solidifying the molten mixture to form a tungsten containing titanium aluminide alloy having a dispersion of the added tungsten boride particles substantially without the formation of WB precipitate clusters.

2. A method of adding boron to a heavy metal containing titanium aluminide alloy to form a boride dispersion in the heavy metal containing titanium aluminide, comprising:

(a) forming molten tantalum containing titanium aluminide alloy, (b) adding TaB particles to the molten tantalum containing titanium aluminide alloy to form a molten mixture, the TaB particles having the same form as TaB precipitate clusters, (c) cooling and solidifying the molten mixture to form a tantalum containing titanium aluminide alloy having a dispersion of the added tantalum boride particles substantially without the formation of TaB precipitate clusters.

3. A method as claimed in claim or 1 or 2, wherein the titanium aluminide alloy comprises up to 2.0 at % boron.

4. A method as claimed in claim 3 wherein the titanium aluminide alloy comprises up to 1.0 at % boron.

5. A method as claimed in claim 1 or 2 a wherein the titanium aluminide alloy comprises more than 0.5 at % boron.

6. A method as claimed in claim 1 or 2 wherein the titanium aluminide alloy comprises a gamma titanium aluminide.

7. A method as claimed in claim 6 wherein the gamma titanium aluminide alloy preferably comprises 44 to 52 at % aluminum, one or more of tungsten and tantalum each in an amount of 0.05 to 8.0 at %, up to 2.0 at % boron and balance titanium plus incidental impurities.

8. A method as claimed in claim 7 wherein the gamma titanium aluminide additionally comprises up to 3 at % chromium, up to 6 at % niobium, up to 2 at % manganeses.

9. A method as claimed in claim 7 wherein the gamma titanium aluminide alloy comprises 45 to 47 at % aluminum, 2 to 6 at % niobium, 0.25 to 2 at % tungsten and the balance titanium plus incidental impurities.

10. A method as claimed in claim 9 wherein the gamma titanium aluminide comprises 45 at % aluminum, 5 at % niobium and 1 at % tungsten.

11. A method as claimed in claim 10 wherein the gamma titanium aluminide alloy comprises 1 to 2 at % chromium and/or 1 to 2 at % manganese.

12. A method as claimed in claim 1 or 2 wherein the method comprises forming the titanium aluminide alloy into a turbine blade, a turbine vane, a compressor blade, or a compressor vane.

13. A method as claimed in claim 12 wherein the titanium aluminide alloy is cast or forged.

* * * * *